United States Patent [19]

Collin et al.

[11] Patent Number: 4,532,499

[45] Date of Patent: Jul. 30, 1985

[54] MEANS FOR DETECTING THE CONTACT WEAR OF ELECTRICAL SWITCHING DEVICES

[75] Inventors: Thorbjörn Collin, Västerås; Börje Erikmats, Ludvika; Svante Forsberg, Ludvika; Harry Göransson, Ludvika; Lars Sander, Västerås; Carl E. Sölver, Ludvika, all of Sweden

[73] Assignee: ASEA Aktiebolag, Västerås, Sweden

[21] Appl. No.: 535,781

[22] Filed: Sep. 26, 1983

[30] Foreign Application Priority Data

Oct. 25, 1982 [SE] Sweden ..... 8206040

[51] Int. Cl.[3] ..... G08B 21/00

[52] U.S. Cl. ..... 340/644; 200/148 R; 200/148 B; 250/227

[58] Field of Search ..... 340/644, 815.31; 324/96, 71.2; 250/227; 350/96.29, 96.1; 200/148 R, 148 B

[56] References Cited

U.S. PATENT DOCUMENTS 4,184,145 1/1980 Fima ..... 340/52 A

*Primary Examiner*—James L. Rowland
*Assistant Examiner*—Jeffery A. Hofsass
*Attorney, Agent, or Firm*—Watson Cole Grindle & Watson

[57] ABSTRACT

In a means for detecting the wear of a current interrupting contact (4) there is used a light conductor (12) as a connecting link between the contact (4) and a detector (20) arranged at ground potential. The light conductor is inserted into an aperture (11) provided from the rear side of the contact, the bottom of said aperture being positioned at the level corresponding to a worn out contact. When the wear has grown so great that the light conductor (12) is exposed, the light or heat of the breaking arc will generate or interrupt a light signal, which via the light conductor is transmitted to the detector.

5 Claims, 5 Drawing Figures

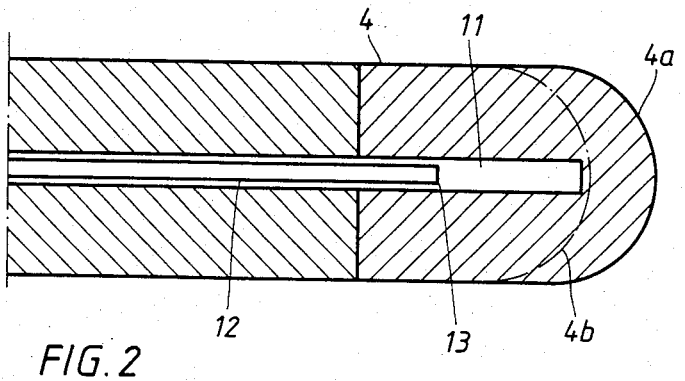
FIG. 2
FIG. 3
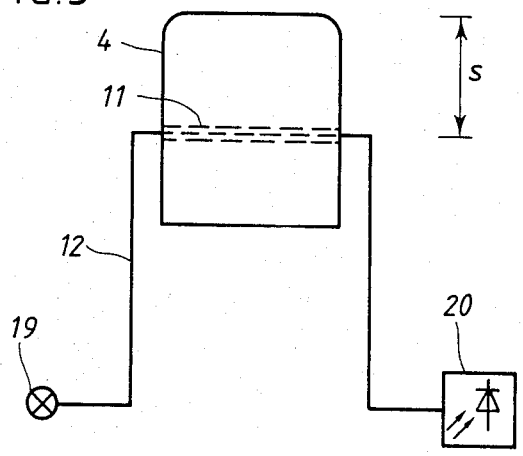
FIG. 4
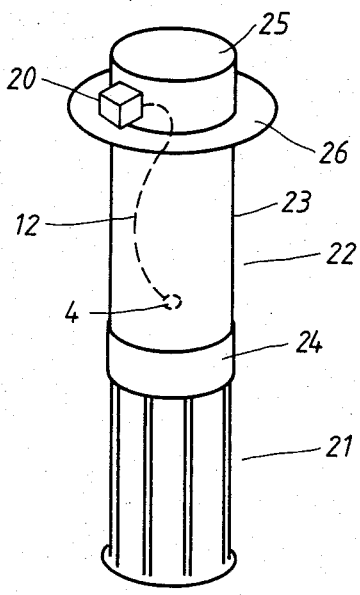
FIG. 5
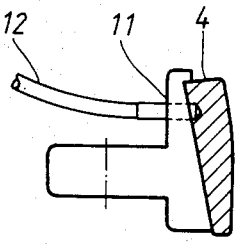

MEANS FOR DETECTING THE CONTACT WEAR OF ELECTRICAL SWITCHING DEVICES

BACKGROUND OF THE INVENTION

The present invention relates to a means for detecting the contact wear of electrical devices having current-interrupting contacts, for example high voltage circuit-breakers, on-load tap changers, etc.

Because of the arc which normally arises between current-interrupting contacts, a certain amount of wear of these contacts occurs. The contacts must therefore be inspected and possibly replaced according to a scheme fixed for each contact device. The intervals between the inspections may be based on operating time or the number of performed operations, or a combination thereof. Usually, therefore, it is presupposed that all operations are carried out at a certain current. In most cases, this presupposition does not correspond to reality. Many operations are carried out at low current or in a current-less state, whereas other operations, due to special operating conditions or faulty functioning of the apparatus, may lead to severe loads on the contacts. Therefore, with predetermined, fixed service intervals many expensive shutdowns and inspections will be carried out without cause, while at the same time there is a risk of damage to apparatus due to worn contacts.

SUMMARY OF THE INVENTION

The object of the present invention is to provide a means for detecting the magnitude of the contact wear on current-interrupting contacts, so that the times for the necessary service can be more easily fixed. The means shall be such that also arcing contacts which are positioned at a high potential in relation to ground can be supervised. According to the invention, this is achieved by providing an aperture behind the wear surface of one of the contacts in a contact pair, said aperture passing through the contact at, or has its bottom located at, the level which corresponds to a consumed contact, there being provided in said aperture a light conductor consisting of at least one optical fiber, said light conductor serving as a connecting link for transmission of a signal from the contact to a detector when the wear has reached said level.

BRIEF DESCRIPTION OF THE DRAWINGS

The invention will be explained in greater detail by describing different embodiments with reference to the accompanying drawing, in which FIG. 2 shows an axial section of the fixed arcing contact of the breaker according to FIG. 1, FIG. 3 shows the principle of a second embodiment of the invention, FIG. 4 shows a schematic perspective of an on-load tap changer with a means according to a third embodiment of the invention, and FIG. 5 shows a section through one of the fixed contacts of the on-load tap changer according to FIG. 4.

DESCRIPTION OF THE PREFERRED EMBODIMENTS

Figure 1:
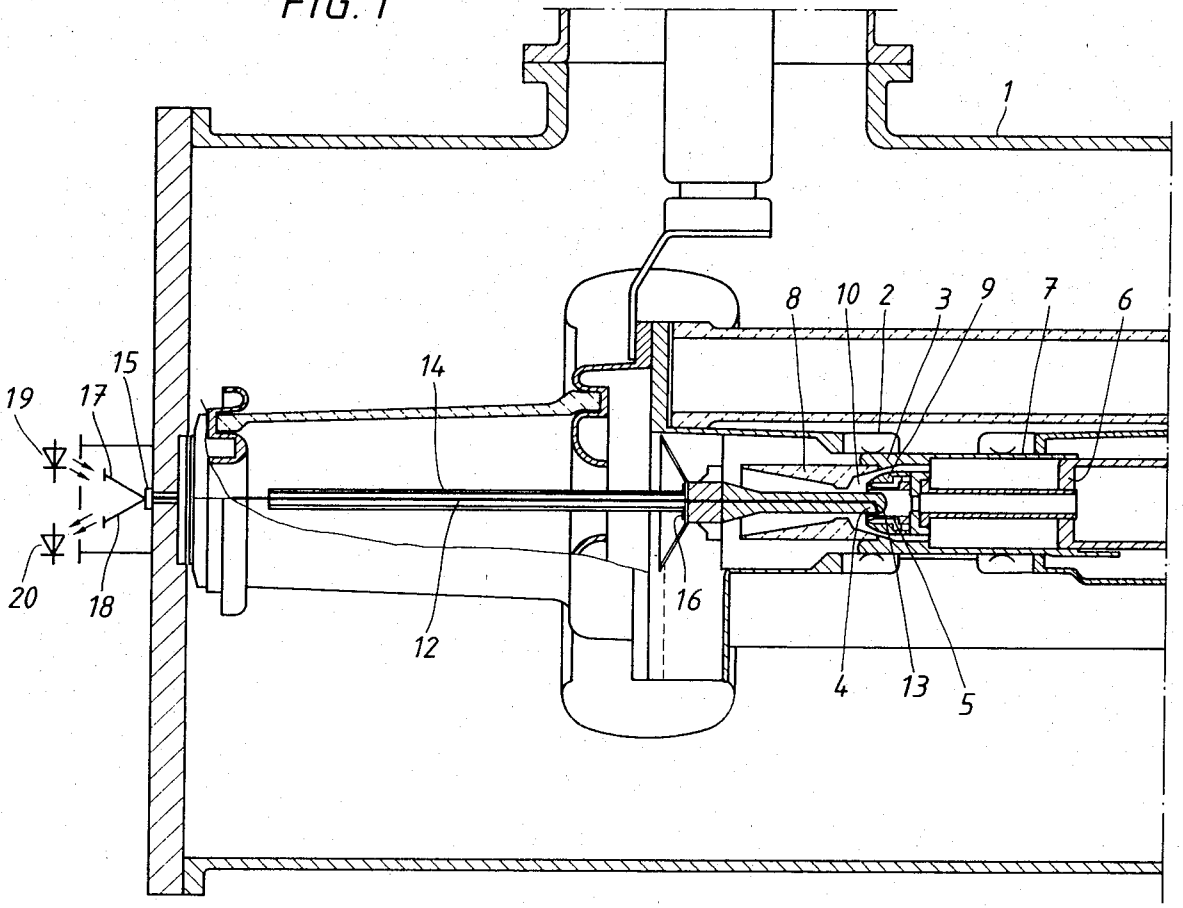
FIG. 1 shows an axial section of a pressure gas circuit-breaker with a means according to a first embodiment of the invention.

The circuit-breaker shown in FIG. 1 is enclosed in a normally grounded metal container 1 which is filled with sulphur hexafluoride gas ($SF_6$) having an overpressure of a few atmospheres. The circuit-breaker has a main contact unit with a fixed and a movable main contact 2 and 3, respectively, and an arcing contact unit with a fixed and a movable arcing contact 4 and 5, respectively. The movable contacts 3 and 5 are connected to an operating device via an axially displaceable pull rod (not shown). The circuit-breaker is provided with a pump device consisting of a fixedly arranged piston 6 and a cylinder 7, which is fixed to the movable contacts 3, 5 and moves together with these. On the movable contacts there are also mounted a blast nozzle 8 and an inner sleeve 9 of insulating material, between which an arc-extinguishing channel 10 is formed.

In the fixed arcing contact of the circuit-breaker there is provided - from the rear side of the contact - an axial aperture 11 (FIG. 2), into which a light conductor 12 is inserted, at the end of which a reflector 13 has been mounted. The reflector may, with advantage, consist of the end surface of the conductor, which for this purpose has been prepared in a suitable manner, for example by grinding, silver-plating, etc. The conductor 12 is made of a temperature-resistant material, for example quartz glass with a softening temperature of 1730° C., and its diameter may be, for example, 0.4 mm. In those cases where the light conductor is used in a circuit-breaker where corrosive atmosphere may arise, it should have a protective coating of, for example, polyetrafluoro ethylene. In the embodiment shown, the light conductor is extended through a protective tube 14 of polyester fiber reinforced epoxy. At the point where the conductor passes through the metal enclosure 1, a seal 15 is arranged. Further, a seal 16 against the $SF_6$ gas is arranged inside the enclosure.

The reflector 13 is positioned in such a position in relation to the surface of the contact that, when the contact is new, it is uninfluenced by the temperature from the foot point of the arc on the contact surface. At the same time the position shall be such that, when maximally permitted wear has occurred, the temperature rise of the reflector causes destruction thereof.

Outside the earthed metal enclosure 1, the light conductor 12 is branched into two branch conductors 17 and 18. Light can be sent into one branch conductor 17 with the aid of a light-emitting diode (LED) 19 or another light source. The light is reflected by the reflector 13, and part of the reflected light is conducted into the branch conductor 18 and is detected by a photo-diode 20 arranged at the end of this branch conductor.

When examining a "healthy" circuit-breaker, where the wear has still not reached a critical stage and, consequently, the reflector is intact, reflection is obtained as an indication that the circuit-breaker is still not in need of repair. When examining a worn-out circuit-breaker, where the wear has reached or exceeded the critical limit, no reflection is obtained since the reflector is destroyed. This is a sign indicating that renovation should be carried out.

To obtain a sufficiently distinct indication, the light conductor 12 is placed in the contact 4 as shown in FIG. 2. The end surface of the contact in a new contact is here designated 4*a*, and the end surface in cases of maximally permitted wear is designated 4*b*. The reflector 13 is positioned withdrawn from the bottom of the channel 11. When the opening of the channel is laid bare during burn-through, the temperature increases rapidly in the channel to a level which is fatal for the reflector 13.

FIG. 3 shows schematically another embodiment of the invention, in which a light conductor 12 is passed through a hole 11 in a fixedly arranged current-interrupting contact 4 at a depth s corresponding to maximally permitted wear. When the detected contact 4 is so worn that the light conductor has been exposed, it will be burnt off, whereby the ability of the light conductor to transmit light ceases.

In the normal state, a lamp 19 emits light to the light conductor 12, which conducts the light via one or more contacts 4, positioned at high potential, to a light detector 20. The lamp and the light detector are suitably arranged at ground potential. When the detector 20 is not able to detect any light, either the detecting circuit is broken or the maximally permitted wear of a contact has been exceeded. Since the detecting circuit is active in normal state and passive only in case of a fault, a continual control of a correct functioning of the means is provided.

FIGS. 4 and 5 show schematically a third embodiment of the invention, in which the light generated during the current interruption is used to give a signal to ground via the light conductor. In this case the invention is employed with an on-load tap changer comprising a tap selector 21 and a diverter switch 22. The diverter switch is arranged in a housing consisting of an insulating cylinder 23 with a bottom portion 24 and a top portion 25. The top portion 25 is provided with a mounting flange 26, so that it may be mounted suspended from the cover of a transformer tank or on-load tap changer tank.

One of the fixed main contacts 4 of the diverter switch is schematically shown in FIG. 4 and on an enlarged scale and partially in section in FIG. 5. This contact 4 is provided with a hole 11 from the rear side. The bottom of the hole is located at the level which corresponds to a worn out (or almost worn out) contact. A light conductor 12 is mounted in the hole as a connecting link between the contact and a detector 20 at ground potential. This detector converts the light signal from the contact into an electrical signal for alarm.

All the main contacts in the on-load tap changer need not be provided with light conductors, since the wear on parallel contacts within the same phase and also between the phase is relatively even. It is therefore sufficient to detect the wear on one or two contacts for each on-load tap changer.

To provide continual control of the function of the means, one of the contacts can suitably be penetrated and be provided with a separate light conductor, which thereby receives a signal for each switching. At the same time, this provides a possibility for other control functions, for example the number of switchings, arcing times, restrikings, etc.

What is claimed is:

1. Means for detecting contact wear in an electrical device which includes at least one pair of current-interrupting contacts (4, 5), characterized in that in one (4) of the contacts of said contact pair (4, 5) there is provided, behind the wear surface of the contact, an aperture (11) which passes through the contact (4) at, or has its bottom located at, the level which corresponds to a worn out contact, and that a light conductor (12) comprising at least one optical fiber is arranged in said aperture (11), which light conductor serves as a connecting link for transmission of a signal from the contact (4) to a detector (20) when the wear has reached said level.

2. Means according to claim 1, in which one end of the light conductor (12) is provided with a reflector (13) which is inserted into the aperture (11) in the contact (4), and the light conductor comprises optical fibers (17, 18) for leading in light from a light source (19) to the reflector (13) and for leading out at least part of the light, reflected from the reflector, to said detector (20).

3. Means according to claim 1, in which the light conductor (12) passes through the aperture (11) provided in the contact (4), whereby a light source (19) is arranged at one end of the light conductor and said detector (20) is arranged at the other end.

4. Means according to claim 1, in which one end of the light conductor (12) is arranged in the aperture provided in the contact in such a way that the conductor end, when the contact is burnt through, is illuminated by the breaking arc, whereby a light signal is transmitted via the light conductor (12) to the detector (20).

5. Means according to claim 4, in which in one of the contacts in said device there has been provided a through-going aperture extending to the wear surface of the contact, in which a separate light conductor has been mounted, through which, for control purposes, a light signal is led to the detector (20) during each switching with an arc.

* * * * *